US008109648B2

(12) United States Patent
Laso et al.

(10) Patent No.: US 8,109,648 B2
(45) Date of Patent: Feb. 7, 2012

(54) LIGHT FIXTURE HAVING SOCKET TRACK ASSEMBLIES WITH DETACHABLE ROW ALIGNER

(75) Inventors: Jose Antonio Laso, Newnan, GA (US); Jamey Nunnally Vaughan, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 445 days.

(21) Appl. No.: 12/372,393

(22) Filed: Feb. 17, 2009

(65) Prior Publication Data

US 2010/0208476 A1 Aug. 19, 2010

(51) Int. Cl.
*F21V 21/005* (2006.01)

(52) U.S. Cl. ..... 362/217.13; 362/219

(58) Field of Classification Search ..... 362/217.01, 362/219, 220, 217.13
See application file for complete search history.

(56) References Cited

U.S. PATENT DOCUMENTS 4,422,132 A * 12/1983 Trowbridge ..... 362/220
4,992,915 A 2/1991 Meister

OTHER PUBLICATIONS

Canlyte, CFI Fluorescent, Industrial Luminaires, Surface Strip SB Series, www.canlvte,com, 2009, p. 90.
SIMKAR Corporation, CH Original Patented Striplite; www.simkar.com; 2009, p. 37.

* cited by examiner

*Primary Examiner* — David V Bruce
(74) *Attorney, Agent, or Firm* — King & Spalding LLP

(57) ABSTRACT

A light fixture includes an elongated channel and one or more lamp socket assemblies. The lamp socket assemblies include at least one lamp socket and a removable row aligner device. The row aligner device is separated from the lamp socket assembly and one side of the row aligner device is positioned in the base of the channel. A second light fixture slidably receives a second side of the row aligner device to provide a properly aligned row of two light fixtures. The lamp socket assemblies include pivot tabs that extend through and pivot within apertures of the channel. The pivot tabs allow the socket track assemblies to rotate from a shipping position where the lamps sockets are housed within the channel to an operational position where the lamp sockets are positioned upright for receiving lamps.

29 Claims, 5 Drawing Sheets

LIGHT FIXTURE HAVING SOCKET TRACK ASSEMBLIES WITH DETACHABLE ROW ALIGNER

TECHNICAL FIELD

The present invention relates generally to light fixtures, and more specifically to light fixtures having lamp socket assemblies with detachable row aligners.

BACKGROUND

A strip light fixture is generally a light fixture having an elongated channel with at least one lamp socket attached at either end. Straight elongated lamps, such as a linear fluorescent lamp, can be placed in the lamp sockets. Typically, an electrical ballast is housed within the channel to regulate the amount of current flowing from an electrical source to the lamp via the lamp sockets.

Linear fluorescent strip light fixtures are typically installed to provide lighting in large spaces, such as warehouses, retail stores, and office buildings. The strip light fixtures are commonly arranged in long, continuous rows and can be mounted directly to a wall or ceiling or suspended from a ceiling using hangars. When installed using hangars, it can often be difficult to align the strip light fixtures accurately. If the strip light fixtures are not aligned properly, the result can be aesthetically displeasing. Conventional methods for aligning a row of strip light fixtures typically require the use of additional hangars and/or cumbersome connection devices. The installation of these hangars and connection devices lead to increased labor time and costs.

Accordingly, a need exists for a strip light fixture with an improved alignment system that can reduce time and costs associated with installation. A need also exists for a strip light fixture with minimal assembly required for installers.

SUMMARY OF THE INVENTION

The present invention provides a light fixture with a detachable row aligner device. The light fixture includes an elongated channel having a pair of sidewalls between which lamp socket assemblies are pivotally mounted. Each lamp socket assembly includes at least one lamp socket for receiving a lamp and providing electrical power to the lamp. The lamp sockets can receive the electrical power from a ballast disposed in the light fixture. The ballast can receive electrical power from a source outside of the light fixture and control the amount of current passed to the lamps via the lamp sockets.

The lamp socket assemblies include pivot tabs on either side of the lamp socket assemblies. Each pivot tab extends through an aperture in the channel to allow the lamp socket assembly to rotate about an axis defined by the arrangement of the apertures. In a shipping configuration, the lamp socket assemblies are rotated inward to the channel in order for the lamp sockets of the lamp socket assembly to be housed within the channel and a channel cover. During installation of the light fixture, the lamp socket assemblies can be rotated out of the channel into a position whereby the lamp sockets extend upright and significantly perpendicular to the base of the channel.

Each lamp socket assembly can include a detachable row aligner device. When the light fixture is installed in a row arrangement with other light fixtures, the row aligner device can be removed and positioned within the channel of one of the light fixtures. A second light fixture can then be aligned with the light fixture containing the row aligner device by positioning the channel of the second light fixture to receive the row aligner device in row aligners. The lamp socket assembly can include a score line, a line of die cuts, or a line of perforations for allowing the detachable row aligner device to be removed by bending the detachable row aligner device along the line. When the light fixture is not installed in a row arrangement with other light fixtures, the detachable row aligner device can remain attached to the lamp socket assembly to serve as an end cap for the light fixture.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
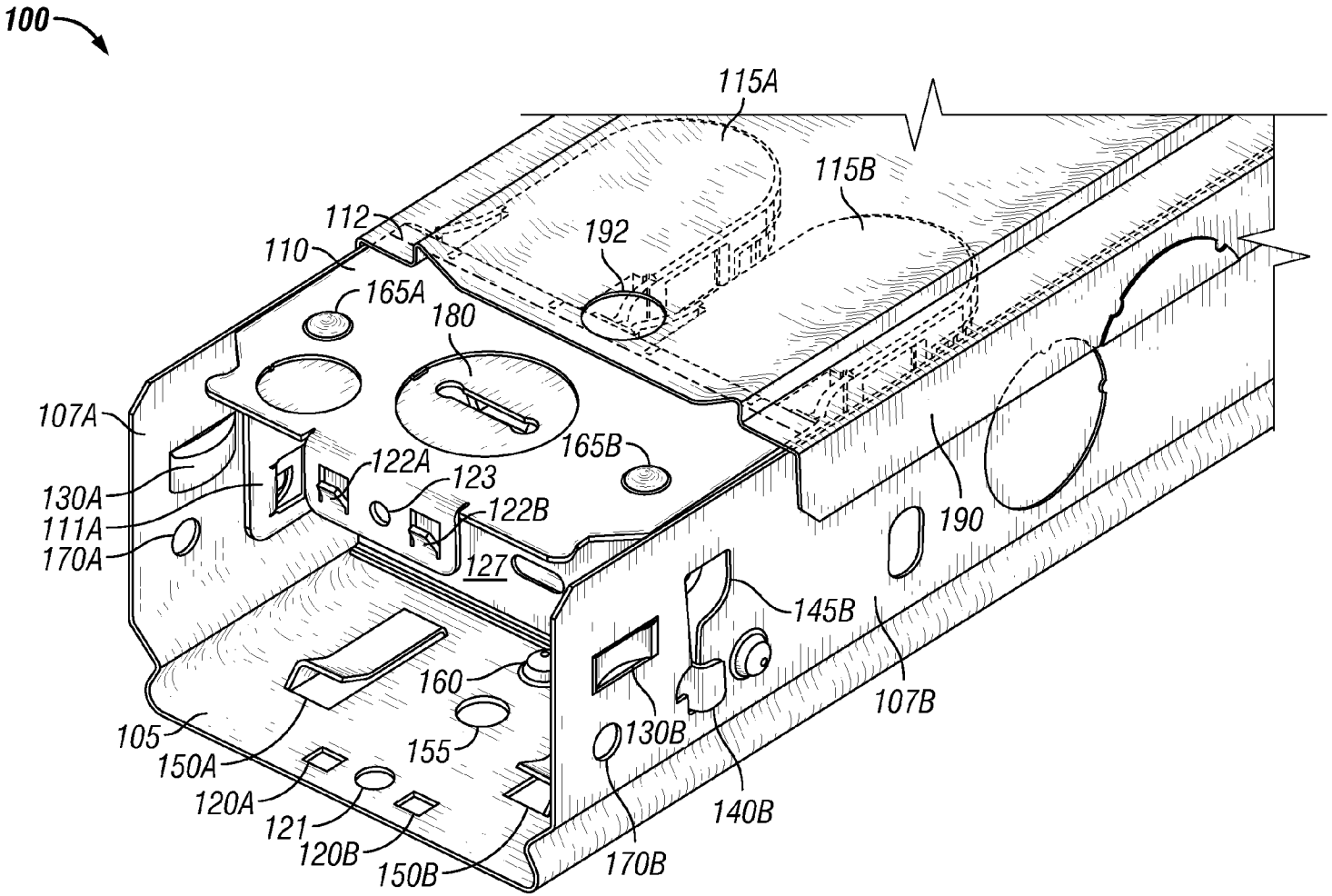
FIG. 1 is a partial perspective view of an end portion of a light fixture in accordance with one exemplary embodiment of the present invention.

Many aspects of the invention can be better understood with reference to the drawings referenced above. The elements and features shown in the drawings are not necessarily to scale, emphasis instead being placed upon clearly illustrating the principles of the exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The following description of exemplary embodiments refers to the attached drawings. Any spatial references herein such as, for example, "upper," "lower," "above," "below," "rear," "between," "vertical," "angular," "beneath," etc., are for the purpose of illustration only and do not limit the specific orientation or location of the described structure.

FIG. 1 is a partial perspective view of an end portion of a light fixture 100 in accordance with one exemplary embodiment of the present invention. In order to provide sufficient detail of the various components of the light fixture 100, only one end of the light fixture 100 is illustrated in FIGS. 1-4. The opposite end of the light fixture 100 can include an identical or similar arrangement to that which is illustrated in FIGS. 1-4.

Referring now to FIG. 1, the light fixture 100 includes an elongated channel 105 having two sidewalls 107A, B protruding upward from a base of the channel 105 forming a generally U-shaped open channel 105. The light fixture 100 also includes a channel cover 190 that, when installed to close the top of the channel 105, follows the contour of the upper edge of the sidewalls 107A, B. In certain exemplary embodiments, the channel 105 and its side walls 107A, B are a one-piece metal structure and can include a metal channel cover 190. Alternatively, other configurations including multi-piece arrangements, and other materials, such as plastic can be used to construct the channel 105 of the light fixture 100. In certain exemplary embodiments, the channel cover 190 is translucent.

Figure 4A:
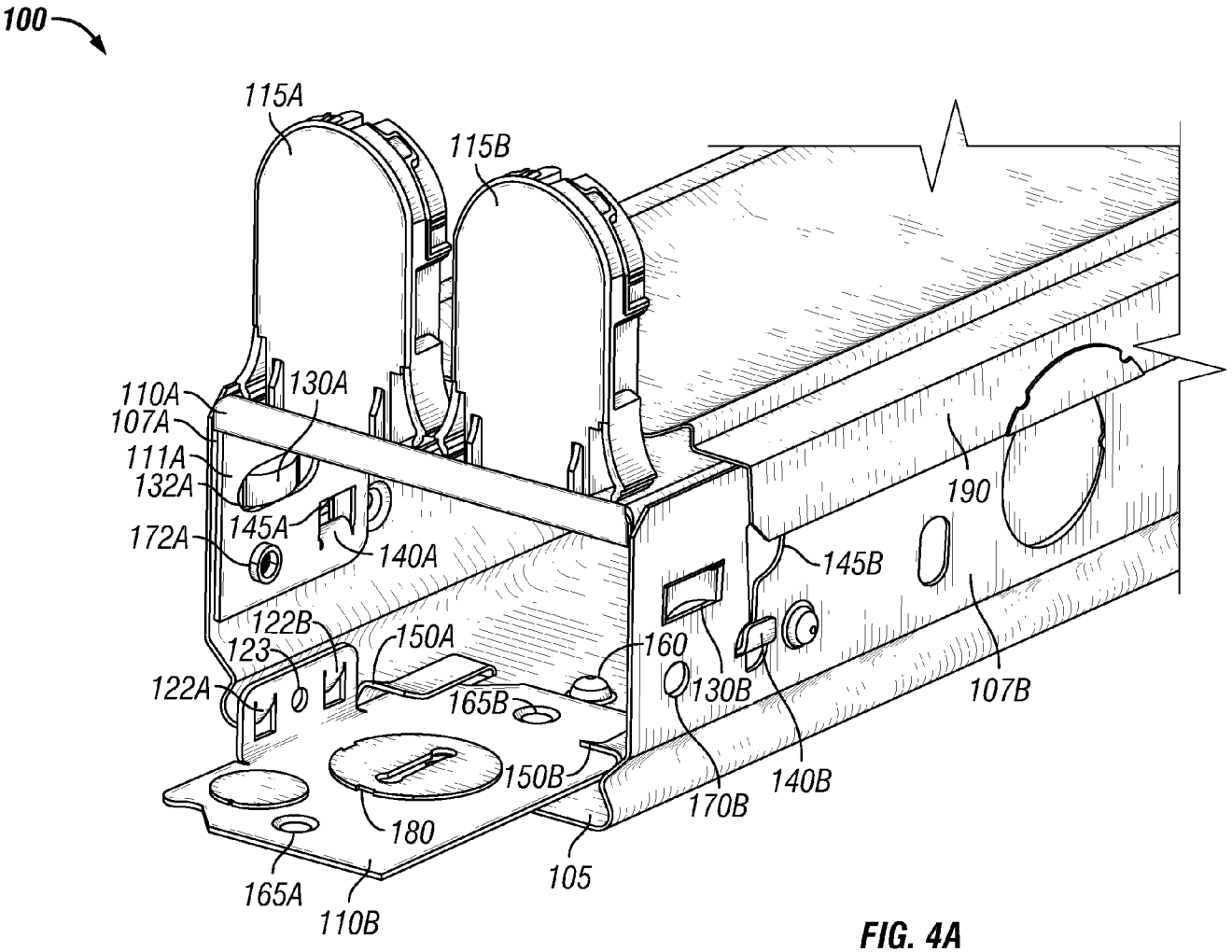
FIG. 4A is a partial perspective view of the light fixture of FIG. 1 illustrating row aligner functionality in accordance with one exemplary embodiment of the present invention.
Figure 4B:
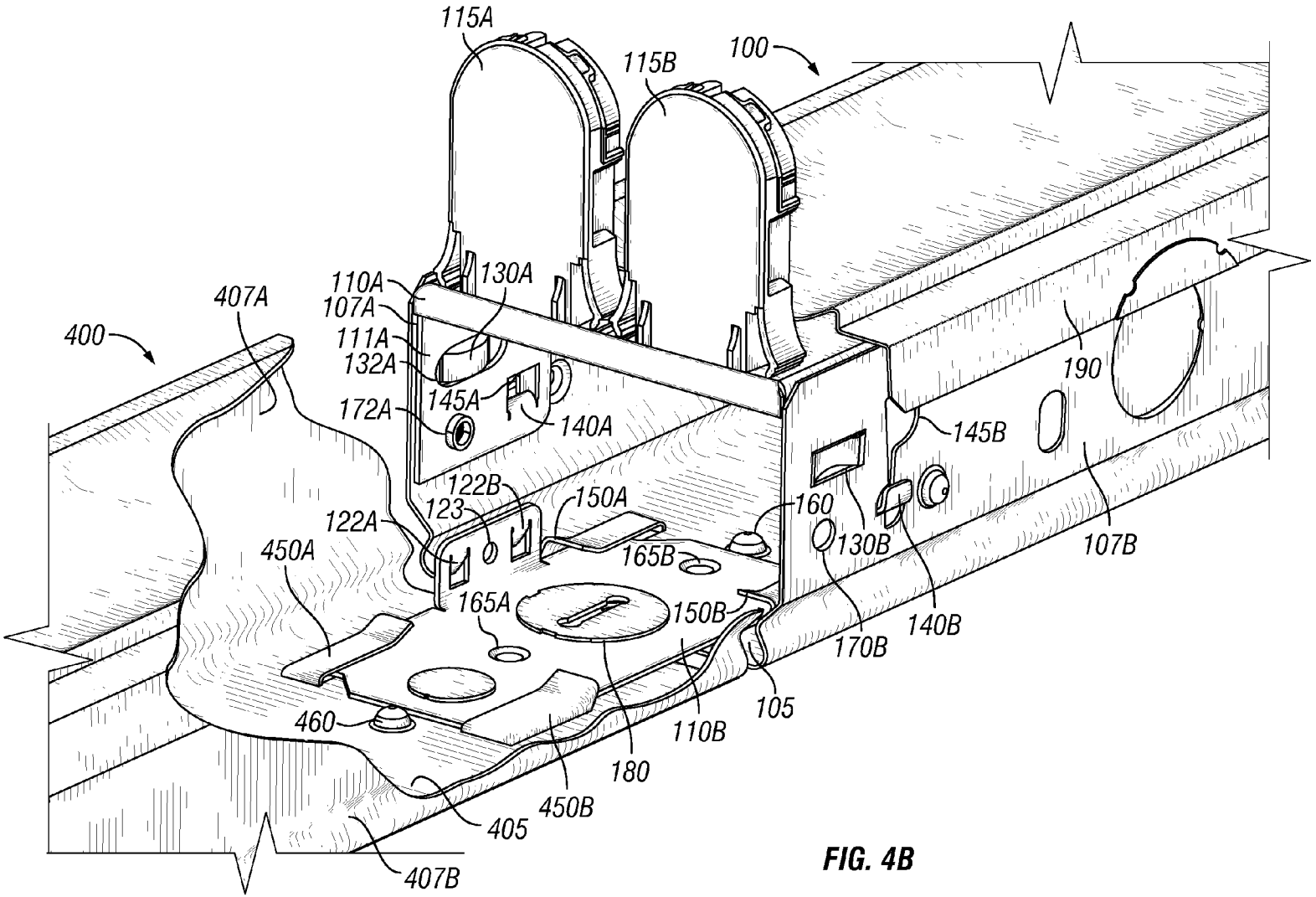
FIG. 4B is a partial perspective view of the light fixture of FIG. 1 aligned with a second light fixture using a row aligner device in accordance with one exemplary embodiment of the present invention.

Attached at either or both ends of the channel 105 is a socket track assembly 110 having two lamp sockets 115A, B attached to a mounting base 110A (See FIGS. 4A and 4B). Each lamp socket 115A, B receives and provides electrical power to a lamp, such as a linear fluorescent lamp (not shown). The lamp sockets 115A, B can typically receive the electrical power from a ballast (not shown) mounted in or near the light fixture 100. When mounted inside the light fixture 100, the ballast receives electrical power from an outside source by way of wires that are run through a cutout 180 in the socket track assembly 110. However mounted, the ballast controls the amount of current flowing into the lamp sockets 115A, B.

Although in this exemplary embodiment the socket track assembly 110 includes two lamp sockets 115A, B, the number two is exemplary and non-limiting. Various other embodiments can include socket track assemblies having any number of lamp sockets 115A, B. For example, a common conventional light fixture includes only one lamp socket attached at either end of a channel for holding a single linear fluorescent lamp.

The socket track assembly 110 also includes two flanges 111A, B (See FIGS. 2A and 2B for a view of 111B) extending from the mounting base 110A and positioned adjacent to the inside surfaces of the sidewalls 107A, B. As best illustrated in FIGS. 4A and 4B, each of the two flanges 111A, B include three separate mechanisms for securing the socket track assembly 110 in position with the channel 105. First, each flange 111A, B of the socket track assembly 110 includes a pivot tab 140A, B that interacts with a respective shaped aperture 145A, B. As will be discussed in greater detail with reference to FIG. 2, the pivot tabs 140A, B and respective apertures 145A, B are configured to allow the socket track assembly 110 to rotate inward to the channel 105 for shipping and outward from the channel 105 for operational use with lamps. Second, each flange 111A, B of the socket track assembly 110 includes an aperture 132A, B that receives a respective raised tab 130A extending inward from each of the respective sidewalls 107A, B of the channel 105 after the socket track assembly 110 has been rotated outward from the channel 105 for operational use. Third, each flange 111A, B of the socket track assembly 110 includes a hole 172A, B (See FIGS. 4A and 4B) for receiving a screw (not shown) or other connection device via an aperture 170A, B in the channel 105.

The socket track assembly 110 also includes a member 127 disposed orthogonally from the mounting base 110A adjacent to the bottom of the lamp sockets 115A, B. The member 127 includes an aperture for receiving a fastener 305 (See FIG. 3) via an aperture 192 in the channel cover 190 and thereby securing the channel cover 190 to the light fixture 100.

The light fixture 100 is illustrated in FIG. 1 in its shipping configuration. In this shipping configuration, the socket track assembly 110 is rotated inward to the channel 105 to house the lamp sockets 115A, B within the channel 105 and beneath the installed channel cover 190. The channel 105, along with the channel cover 190, provides protection for the lamp sockets 115A, B during shipment. Because the lamp sockets 115A, B are attached to the channel 105 in this shipping configuration, the lamp sockets 115A, B can be prewired to the ballast prior to shipping. This pre-wiring of the ballast to the lamp sockets 115A, B provides reduced installation time and also reduces the chance of wiring errors that occur during installation.

Each end of the light fixture 100 is configured during installation based on the intended use of the light fixture 100. If the light fixture 100 is installed in a continuous row with other light fixtures, one or both ends of the light fixture 100 can be configured to align with another light fixture. If the light fixture 100 is not installed in a continuous row with other light fixtures, both ends of the light fixture 100 can be configured to serve as end caps. The end cap configuration is discussed in more detail with reference to FIG. 2, while the continuous row configuration is discussed in more detail with reference to FIG. 4. The light fixture 100 includes various components for each configuration that will be summarized below with reference to FIG. 1.

Referring to FIG. 1, the socket track assembly 110 includes a line of weakness 112 for separating a row aligner device 110B from the mounting base 110A of the socket track assembly 110 as illustrated in FIGS. 4A and 4B. This line of weakness 112 can include die cuts, perforations, a score line, or other suitable methods for allowing the row aligner device 110B to be manually separated from the mounting base 110A along the line of weakness 112.

To configure the end of the light fixture 100 to align with another light fixture, the row aligner device 110B can be separated from the mounting base 110A at the line of weakness 112 and positioned in the channel 105. The row aligner device 110B includes raised areas or dimples 165A, B which interact with a respective aperture 155 in the channel 105 of the light fixture 100 and a channel of the second light fixture to position the row aligner device 110B within the two light fixtures. The channel 105 includes two row aligners 150A, B for slidably receiving the row aligner device 110B. In this exemplary embodiment, the channel 105 also includes a stop 160 which acts to limit the depth at which the row aligner device 110B enters the channel 105 when sliding into the row aligners 150A, B. This stop 160 is optional as other stopping mechanisms can be employed, such as configuring the row aligners 150A, B within the channel whereby an end of the row aligner device 110B abuts an end of the row aligners 150A, B when the row aligner device 150B is positioned in the channel 105 as shown in FIGS. 4A and 4B.

If the end of the light fixture 100 is not to be aligned with another light fixture, the row aligner device 110B remains attached to the mounting base 110A, leaving the socket track assembly 110 intact. Thus, when the socket track assembly 110 is rotated fully outward from the channel 105, the socket track assembly 110 serves as an end cap for the channel 105.

The row aligner device 110B portion of the socket track assembly 110 includes two tabs 122A, B that engage respective square-shaped apertures 120A, B in the base of the channel 105 to secure the socket track assembly 110 in an operational position after the socket track assembly 110 is rotated outward from the channel 105. More specifically, when the tabs 122A, B engage the apertures 120A, B, the socket track assembly 110 is prevented from rotating back into the shipping configuration. Although in this exemplary embodiment, the apertures 120A, B are square-shaped, the apertures 120A, B and the tabs 122A, B that engage the apertures 120A, B can be other shapes or could include any number of tabs 122A, B and respective apertures 120A, B as will be recognized by one of ordinary skill in the art having the benefit of the present disclosure.

The row aligner device 110B of the socket track assembly 110 also includes a threaded screw hole 123 that aligns with an aperture 121 in the base of the channel 105 when the socket track assembly 110 is secured in the operational position. A connection device, such as a screw, can be inserted through the aperture 121 and tightened into screw hole 123 for further securing the socket track assembly 110 in this operational position. Alternatively, the screw hole 123 can be a non-threaded aperture for use with other connection devices, such as a nut and bolt combination.

Figure 2A:
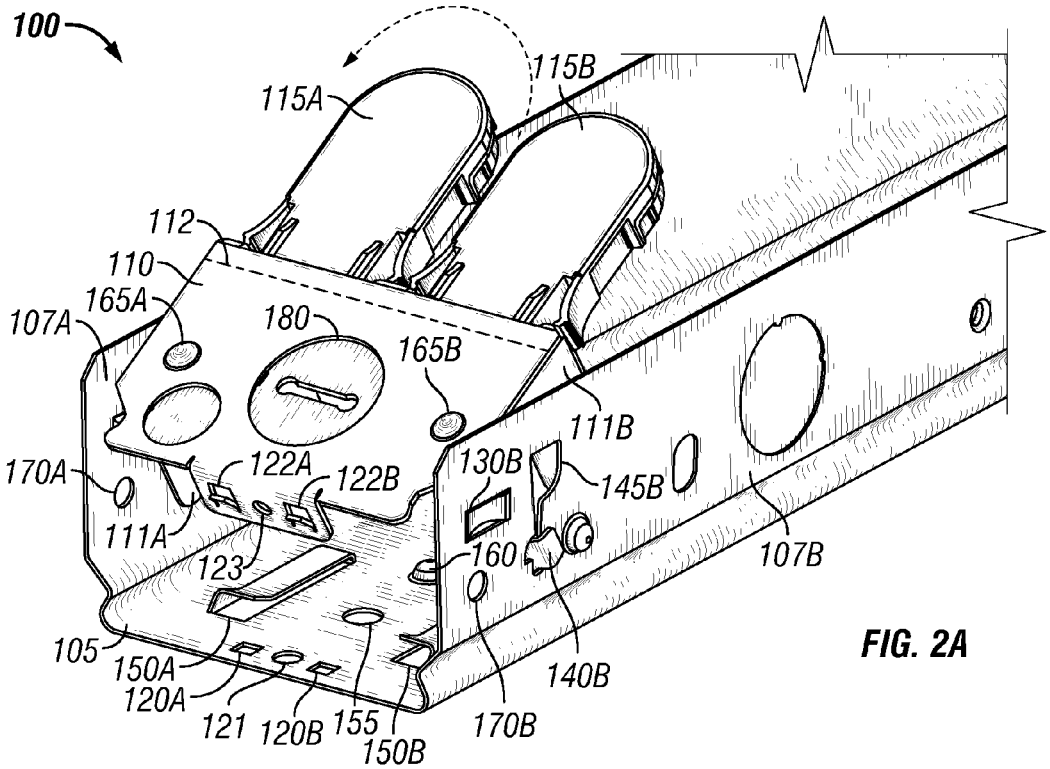
FIGS. 2A and 2B are partial perspective views of the light fixture of FIG. 1 illustrating a socket track assembly rotating into an operational position in accordance with one exemplary embodiment of the present invention.
Figure 2B:
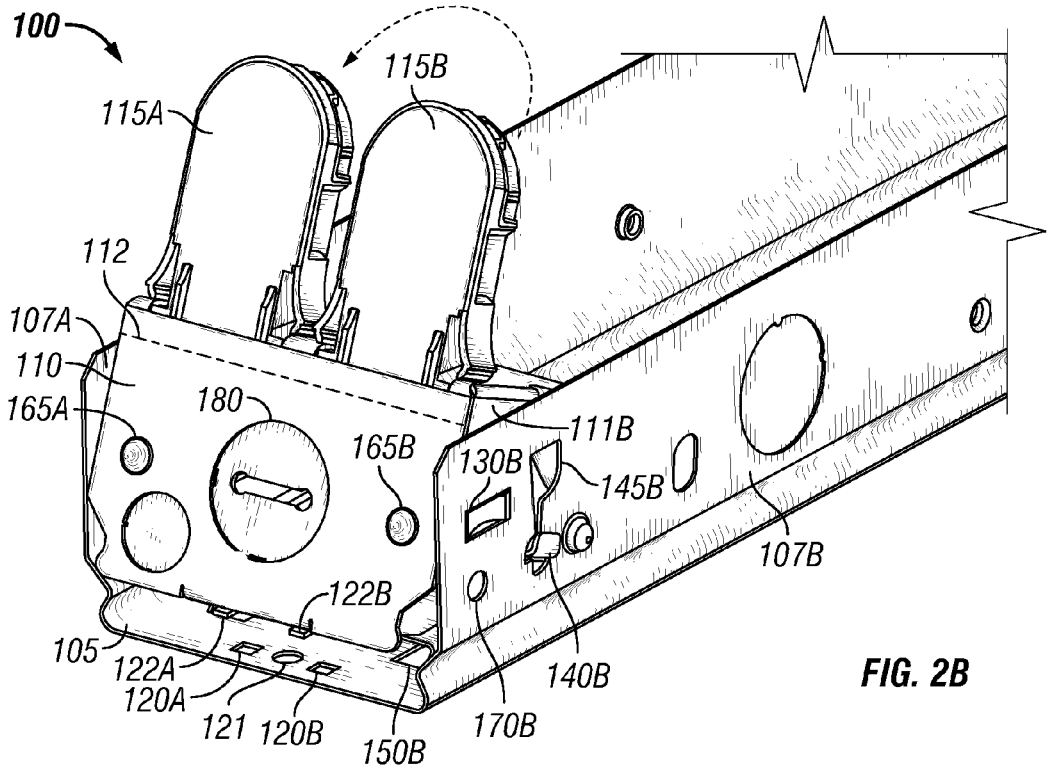

FIGS. 2A and 2B, collectively FIG. 2, are partial perspective views of the light fixture 100 of FIG. 1 illustrating a socket track assembly 110 rotating into an operational position in accordance with one exemplary embodiment of the present invention. Now referring to FIGS. 2A and 2B, the socket track assembly 110 is depicted at different points along its rotation from a shipping configuration where the lamp sockets 115A, B are housed within the channel 105 to an operational position where the lamp sockets 115A, B stand upright with respect to the base of the channel 105. In this operational position, the row aligner devices 110B of the socket track assembly 110 remain attached to the mounting base 110A to serve as an end cap for the channel 105.

As briefly discussed above with reference to FIG. 1, the pivot tabs 140A, B and their respective apertures 145A, B in the channel 105 are configured to allow the lamps sockets 115A, B to rotate inward into the channel 105 for shipping and outward from the channel 105 for operational use with lamps.

Referring to FIG. 2, the apertures 145A, B are aligned horizontally with one another on the sidewalls 117A, B to provide an axis of rotation for the socket track assembly 110. The shape of the apertures 145A, B and the shape of the pivot tabs 140A, B are designed to limit the degree of rotation about this axis of rotation. In this embodiment, the pivot tabs 140A, B are substantially rectangular with each having an end that extends through its aperture 145A, B and curls about the outside surface of each of the sidewalls 107A, B. When lamp sockets 115A, B are rotated fully inward for shipping, the left side (relative to the end of the tab) of the pivot tab 140B abuts to an edge of the aperture 145B to limit the rotation of the lamp sockets 115A, B further into the channel 105. Although not viewable in the illustration of FIG. 2, the right side of the pivot tab 140A similarly abuts to an edge of the aperture 145A to limit the rotation of the lamp sockets 115A, B further into the channel 105. In one exemplary embodiment, the apertures 145A, B each include a quarter-circle cutout for allowing their respective tab 140A, B to rotate from this fully inward position for shipping to the operational position whereby the lamp sockets 115A, B are vertical with respect to the base of the channel 105. As will be recognized by one of ordinary skill in the art, any of a variety of pivot tab and aperture designs can be used to allow and limit the rotation of the socket track assembly 110.

The light fixture 100 is converted quickly and easily from the shipping configuration, where the lamp sockets 115A, B are rotated fully inward and housed by the channel 105 and the channel cover 190, to the operational position. Referring to FIGS. 1 and 2, the channel cover 190 is first removed from the channel 105. Next, the socket track assembly 110 and lamp sockets 115A, B are rotated outward from the channel 105 until the tabs 122A, B are forced through their respective apertures 120A, B in the base of the channel 105. In addition, the apertures 132A, B in the flanges 111A, B of the socket track assembly 110 receive the raised tabs 130A, B along the sidewalls 107A, B. The combination of the pivot tabs 140A, B interacting with apertures 145A, B, the tabs 122A, B interacting with apertures 120A, B, and the apertures 132A, B receiving the raised tabs 130A, B provide three separate points of contact between the socket track assembly 110 and the channel 105 and therefore three separate mechanisms for securing the socket track assembly 110 with the channel 105 for operational use. Optionally, a pair of screws or other connection devices (not shown) can also be used to secure the socket track assembly 110 to the channel 105 to provide a fourth mechanism for securing the socket track assembly 110 to the channel 105. For example, screws are tightened into the threaded screw holes 172A, B of the socket track assembly 110 via the hole 170A, B in the channel 105. Another screw or other connection device can also be used with holes 121 and 123 to provide a fifth mechanism for securing the socket track assembly 110 to the channel 105. After the socket track assembly 110 is secured in this operational configuration, the channel cover 190 is reattached to the light fixture 100.

Figure 3:
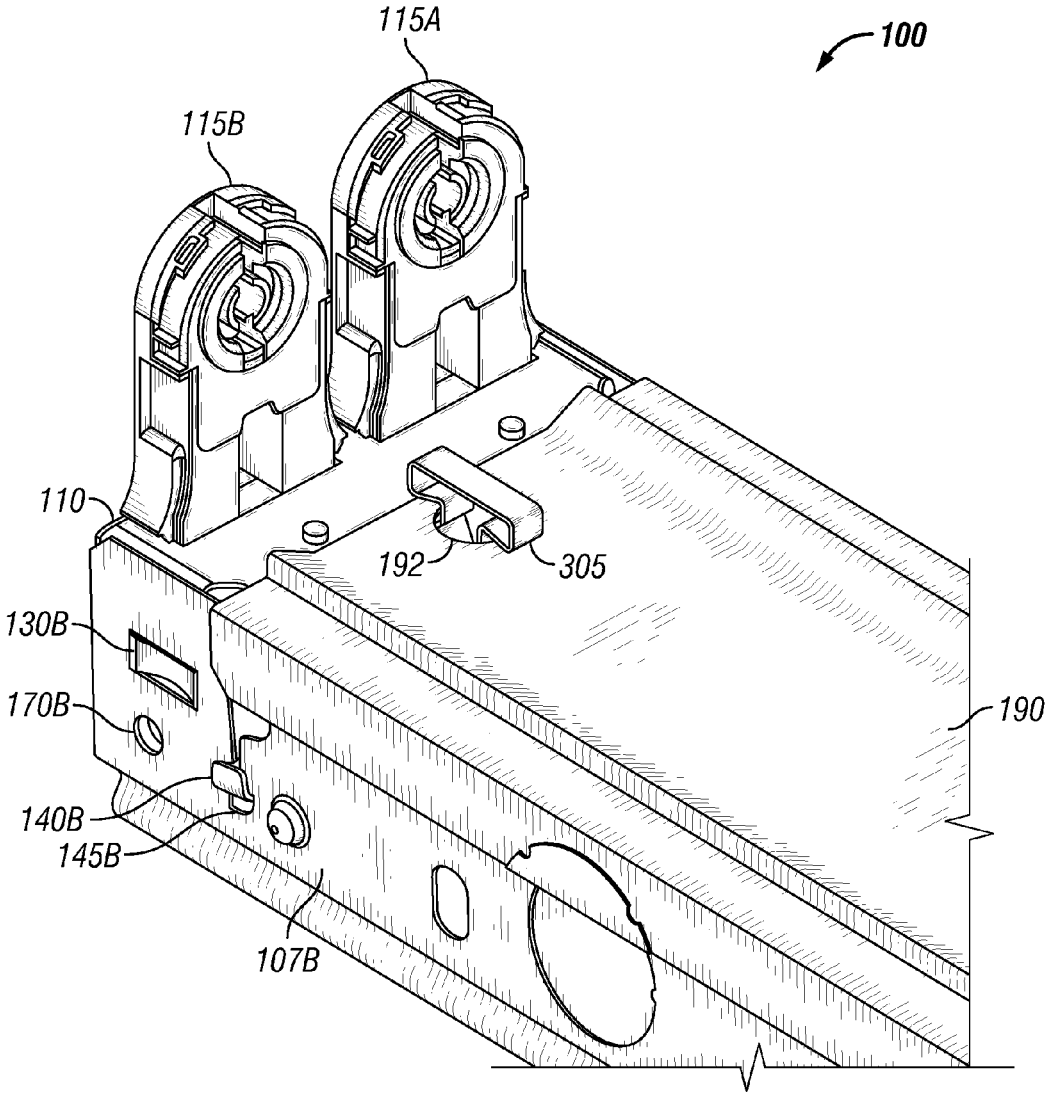
FIG. 3 is a partial perspective view of the light fixture of FIG. 1 illustrating the socket track assembly in an operational position in accordance with one exemplary embodiment of the present invention.

FIG. 3 is a partial perspective view of the light fixture 100 of FIG. 1 illustrating the socket track assembly 110 in an operational position in accordance with one exemplary embodiment of the present invention. In FIG. 3, which is representative of both the end cap configuration and a continuous row configuration (without illustrating a second light fixture), the socket track assembly 110 and lamp sockets 115A, B are rotated outward from the channel 105. The lamp sockets 115A, B stand upright at a substantially ninety degree angle with respect to the base of the channel 105 and are each positioned to receive a lamp. The channel cover 190 is secured to the light fixture 100 using a fastener 305. In certain exemplary embodiments, the fastener 305 is a quarter turn fastener that interacts with a receptacle mounted on the member 127 of the socket track assembly 110 to secure the channel cover 190 to the light fixture 100. Other conventional methods can also be used to secure the channel cover 190 to the light fixture 100, such as clips, screws, pressure fitting, interconnecting tabs or other methods as will be apparent to a person of ordinary skill in the art having the benefit of the present disclosure.

FIGS. 4A and 4B, collectively FIG. 4, are partial perspective views of the light fixture 100 of FIG. 1 illustrating row aligner functionality in accordance with one exemplary embodiment of the present invention. This row aligner functionality provides for multiple light fixtures to be quickly aligned in continuous rows. FIG. 4A illustrates the row aligner device 110B positioned in the light fixture 100, while FIG. 4B illustrates the row aligner device 110 positioned in the light fixture 100 and a second light fixture 400, therefore aligning the light fixture 100 with the light fixture 400 in a significantly straight line. Although the light fixture 400 includes similar components to that of the light fixture 100, some components and structures of the light fixture 400 have been omitted in FIG. 4B in order to illustrate the functionality of the row aligner device 110B.

As briefly discussed above with reference to FIG. 1, the row aligner device 110B is separated from the mounting base 110A at the line of weakness 112 and positioned in the channel 105 to align a second light fixture 400 with light fixture 100. This line of weakness 112 can include die cuts, perforations, a score line, or other suitable methods. Regardless of the method used to produce the line of weakness 112, the line of weakness 112 should be configured to allow the row aligner device 110B to be manually removed from the mounting base 110A, but also provide adequate strength for use as an end cap if necessary.

In this exemplary embodiment, the row aligner device 110B is a thin strip of metal that includes two raised dimples 165A, B with a round shape. Alternatively, the row aligner device 110B along with the socket track assembly 110 can be manufactured from other materials, such as plastic. Additionally, the raised dimples 165A, B can include different shapes or can be excluded entirely from the row aligner device 110B.

In this exemplary embodiment, the base of the channel 105 includes two row aligners 150A, B, a round aperture 155 that receives a dimple 165B of the row aligner device 110B, and a raised stop 160 that work together to align and hold the row aligner device 110B in a fixed position in the channel 105. Similarly, the base of the channel 405 of the light fixture 400 includes two row aligners 450A, B, a round aperture (See 155 of FIG. 1) that receives a dimple 165A of the row aligner device 110B, and a raised stop 460 that work together to align and hold the row aligner device 110B in position in the channel 405.

The row aligner device 110B is slidably inserted into the channel 105 under the two row aligners 150A, B until an edge of the row aligner device 110B reaches the stop 160 and reaches the end of the row aligners 150A, B. In this position, the dimple 165B of the row aligner device 110B rests in the round aperture 155 of the channel 105. In order to make it easier to slide the row aligner device 110B into place between the row aligners 150A, B and the base of the channel 105, the receiving end of each of the row aligners 150A, B is curved upward from the base of the channel 105.

Referring to FIG. 4B, after the row aligner device 110B is positioned in the channel 105, the light fixture 400 is attached to the other side of the row aligner device 110B (the side having dimple 165A). The light fixture 400 is attached to the row aligner device 110B by positioning the light fixture 400 in a way that the row aligner device 110B fits between the base of the channel 405 of the light fixture 400 and its row aligners 450A, B. The light fixture 400 is then moved toward light fixture 100 until the row aligner device 110B abuts against the stop 460 in the channel 405 and against the end of the row aligners 450A, B. In this position, the sidewalls 107A, B abut sidewalls 407A, B of the light fixture 400. Similarly, the base of the channel 105 abuts the base of the channel 405.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light fixture, comprising:

a channel comprising a base, a first sidewall, and a second sidewall; and a socket track assembly mounted between the first and second sidewalls, the socket track assembly comprising a lamp socket mounted on a mounting base of the socket track assembly and a detachable row aligner device.

2. The light fixture of claim 1, wherein the socket track assembly is rotatable within the channel.

3. The light fixture of claim 1, wherein the socket track assembly is mounted between the first sidewall and the second sidewall by a first pivot tab movably coupled to an aperture of the first sidewall and a second pivot tab movably coupled to an aperture of the second sidewall.

4. The light fixture of claim 3, wherein the first pivot tab is coupled to a first flange extending from the mounting base adjacent to the first sidewall and the second pivot tab is coupled to a second flange extending from the mounting base adjacent to the second sidewall.

5. The light fixture of claim 4, wherein the first flange further comprises an aperture configured to receive a protrusion on the first sidewall and the second flange comprises an aperture configured to receive a protrusion on the second sidewall when the lamp socket is rotated outward from the channel into a position for receiving a lamp.

6. The light fixture of claim 4, wherein the base of the channel comprises an aperture configured to receive a tab extending from the socket track assembly when the at least one lamp socket is rotated outward from the channel into a position for receiving a lamp.

7. The light fixture of claim 1, wherein the socket track assembly further comprises a perforated line of weakness between the mounting base and the detachable row aligner device.

8. The light fixture of claim 1, wherein the socket track assembly further comprises a line of weakness comprising a plurality of die cuts between the mounting base and the detachable row aligner device.

9. The light fixture of claim 1, wherein the socket track assembly further comprises a score line between the mounting base and the detachable row aligner device.

10. The light fixture of claim 1, wherein the base of the channel comprises an aperture that receives a protrusion on the row aligner device.

11. The light fixture of claim 1, wherein the base of the channel comprises a raised stop that limits the depth at which the row aligner device extends into the channel.

12. The light fixture of claim 1, wherein the channel comprises at least one elongated strip row aligner positioned along the base of the channel, the elongated strip row aligner operable to slidably receive at least a portion of the row aligner device between the elongated strip row aligner and the base of the channel.

13. The light fixture of claim 12, wherein the at least one elongated strip row aligner is configured with the channel to limit the depth at which the row aligner device extends into the channel.

14. A method for aligning a first light fixture in a substantially straight line with a second light fixture, each light fixture comprising a channel and a pair of socket track assemblies coupled to the channel, each socket track assembly comprising a lamp socket, the method comprising the steps of:

removing a row aligner device from one of the socket track assemblies of the first light fixture;

coupling the row aligner device to the channel of the first light fixture; and aligning the second light fixture with the first light fixture by coupling the row aligner device to the channel of the second light fixture.

15. The method of claim 14, wherein the channel of the first light fixture and the channel of the second light fixture each comprise row aligner slots for slidably receiving the row aligner device within each channel.

16. The method of claim 15, wherein the row aligner device is inserted into the channel of the first light fixture until the row aligner device contacts an end of at least one of the row aligner slots in the first channel.

17. The method of claim 16, wherein the row aligner device is inserted into the channel of the second light fixture until the row aligner device contacts an end of at least one of the row aligner slots in the second channel.

18. The method of claim 14, wherein the channel of the first light fixture and the channel of the second light fixture each comprise a stop for controlling a distance at which the row aligner device penetrates the respective channel, wherein the row aligner device is inserted into the channel of the first light fixture until the row aligner device contacts the stop in the first light fixture.

19. The method of claim 18, wherein coupling the row aligner device to the channel of the second light fixture further comprises receiving the row aligner device into the channel of the second light fixture until the row aligner device contacts the stop in the second light fixture.

20. The method of claim 14, further comprising the step of rotating the socket track assemblies of the first light fixture into a position for receiving a lamp in the lamp sockets of the socket track assemblies.

21. The method of claim 14, wherein the row aligner device comprises at least one protrusion and each channel further comprises an aperture for receiving the protrusion, wherein the row aligner device is inserted into the channel of the first light fixture until at least a portion of the protrusion is received within the aperture in the channel of the first light fixture.

22. The method of claim 21, wherein coupling the row aligner device to the channel of the second light fixture further comprises receiving the row aligner device into the channel of the second light fixture until at least a portion of another protrusion on the row aligner device is received within the aperture in the channel of the second light fixture.

23. A light fixture comprising:

a channel comprising a base, a first sidewall, and a second sidewall; and a socket track assembly comprising:

a lamp socket mounted on a mounting base of the socket track assembly; and a removable row aligner device;

wherein the socket track assembly is coupled to each of the base, the first sidewall, and the second sidewall of the channel.

24. The light fixture of claim 23, wherein the base of the channel comprises at least one aperture and the socket track assembly comprises at least one tab, wherein each of the at least one apertures of the base are configured to receive one of the at least one tabs of the socket track assembly.

25. The light fixture of claim 23, wherein the socket track assembly comprises a first pivot tab and a second pivot tab, wherein the first pivot tab is movably coupled to an aperture in the first sidewall and the second pivot tab is movably coupled to an aperture in the second sidewall.

26. The light fixture of claim 23, wherein the socket track assembly comprises a first flange and a second flange, the first flange extending from the mounting base adjacent to the first sidewall and the second flange extending from the mounting base adjacent to the second sidewall, the first flange comprising an aperture for receiving a protrusion on the first sidewall and the second flange comprising a protrusion on the second sidewall.

27. The light fixture of claim 23, wherein the socket track assembly is rotatable within the channel.

28. The light fixture of claim 23, wherein the socket track assembly further comprises at least one tab and the mounting base comprises a first flange and a second flange, the first flange extending from the mounting base adjacent to the first sidewall and the second flange extending from the mounting base adjacent to the second sidewall, each flange comprising a pivot tab and an aperture, wherein the pivot tab of the first flange is movably coupled to an aperture in the first sidewall and the pivot tab of the second flange is movably coupled to an aperture in the second sidewall, wherein the aperture of the first flange is configured to receive a protrusion on the first sidewall and the aperture of the second sidewall is configured to receive a protrusion on the second sidewall, and wherein the base of the channel comprises at least one aperture, each of the at least one apertures of the base configured to receive one of the at least one tabs of the socket track assembly.

29. The light fixture of claim 28, wherein the protrusion on the first wall is received by the aperture of the first flange, the protrusion on the second wall is received by the aperture of the second flange, and each of the at least one tabs of the socket track assembly are received by one of the at least one apertures of the base when the socket track assembly is rotated into a position for receiving a lamp in the lamp socket.

* * * * *